US008162077B2

(12) United States Patent
Glasgow et al.

(10) Patent No.: US 8,162,077 B2
(45) Date of Patent: Apr. 24, 2012

(54) DRILL BIT WITH WEIGHT AND TORQUE SENSORS

(75) Inventors: Keith Glasgow, Willis, TX (US); Sorin Gabriel Teodorescu, The Woodlands, TX (US); Eric Sullivan, Houston, TX (US); Tu Tien Trinh, Houston, TX (US); Daryl Pritchard, Shenandoah, TX (US); Xiaomin Cheng, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 308 days.

(21) Appl. No.: 12/481,165

(22) Filed: Jun. 9, 2009

(65) Prior Publication Data

US 2010/0307835 A1 Dec. 9, 2010

(51) Int. Cl.
*E21B 47/16* (2006.01)
*E21B 47/01* (2006.01)

(52) U.S. Cl. ..... 175/40; 175/27; 175/57

(58) Field of Classification Search ..... 175/40, 175/57, 27

See application file for complete search history.

(56) References Cited

U.S. PATENT DOCUMENTS 4,094,368 A * 6/1978 Sann et al. ..... 177/128
5,302,805 A * 4/1994 Morris et al. ..... 219/137.71
5,415,030 A 5/1995 Jogi et al.
5,448,227 A 9/1995 Orban et al.
5,475,309 A 12/1995 Hong et al.
5,720,355 A 2/1998 Lamine et al.
6,057,784 A 5/2000 Schaaf et al.
6,150,822 A 11/2000 Hong et al.
6,230,822 B1 5/2001 Sullivan et al.
6,419,032 B1 7/2002 Sullivan et al.
6,540,033 B1 4/2003 Sullivan et al.
6,543,312 B2 4/2003 Sullivan et al.
6,564,883 B2 5/2003 Fredericks et al.
6,571,886 B1 6/2003 Sullivan et al.
6,626,251 B1 9/2003 Sullivan et al.
6,769,497 B2 8/2004 Dubinsky et al.
6,814,162 B2 11/2004 Moran et al.
6,850,068 B2 2/2005 Chemali et al.
7,046,165 B2 5/2006 Beique et al.
7,058,512 B2 6/2006 Downton
7,066,280 B2 6/2006 Sullivan et al.
7,207,215 B2 4/2007 Spross et al.
7,278,499 B2 10/2007 Richert et al.
7,308,937 B2 12/2007 Radford et al.
7,350,568 B2 4/2008 Mandal et al.
7,387,177 B2 6/2008 Zahradnik et al.
7,497,276 B2 3/2009 Pastusek et al.
7,506,695 B2 3/2009 Pastusek et al.
7,510,026 B2 3/2009 Pastusek et al.
2001/0054514 A1 12/2001 Sullivan et al.
2004/0069539 A1 4/2004 Sullivan et al.
2004/0222018 A1 11/2004 Sullivan et al.
2007/0242565 A1 10/2007 Hall et al.
2007/0272442 A1 11/2007 Pastusek et al.
2008/0060848 A1 3/2008 Pastusek et al.
2008/0065331 A1 3/2008 Pastusek et al.
2008/0066959 A1 3/2008 Pastusek et al.
2010/0051292 A1 3/2010 Trinh et al.

OTHER PUBLICATIONS

Dateline Los Almos, a Monthly Publication of Los Almos National Laboratory, Jan. Issue 1997, pp. 1-8.

(Continued)

*Primary Examiner* — Giovanna Wright
(74) *Attorney, Agent, or Firm* — Cantor Colburn LLP

(57) ABSTRACT

A drill bit made according to one embodiment includes a bit body and at least one preloaded sensor in the bit body. In one aspect, the sensor may include a sensor element on a sensor body having a first end and a second end and wherein the sensor is preloaded after placing the sensor body in the bit body. In another aspect, the sensor may be preloaded outside the bit body and then placed in the bit body in a manner that enables the sensor to retain the preloading.

20 Claims, 5 Drawing Sheets

OTHER PUBLICATIONS

Semiconductor-Based Radiation Detectors, http://sensors.lbl.gov/sn_semi.html, pp. 1-5.

NETL: Oil & Natural Gas Projects, Harsh-Environment Solid-State Gamma Detector for Down-hole Gas and Oil Exploration, http://xrfcorp.com/technology/about_czt_detectors.html, pp. 1-5.

NETL: Oil & Natural Gas Projects, Harsh-Environment Solid-State Gamma Detector for Down-hole Gas and Oil Exploration, http://www.netl.doe.gov/technologies/oil-gas/NaturalGas/Projects_n/..., pp. 1-5.

XRF Corporation, About CZT Detectors, http://xrfcorp.com/technology/about_czt_detectors.html, 1 sheet.

* cited by examiner

DRILL BIT WITH WEIGHT AND TORQUE SENSORS

BACKGROUND

1. Field of the Disclosure

This disclosure relates generally to drill bits that include sensors for providing measurements relating to a parameter of interest, the methods of making such drill bits and the apparatus configured to utilize such drill bits for drilling wellbores.

2. Brief Description of the Related Art

Oil wells (wellbores) are usually drilled with a drill string that includes a tubular member having a drilling assembly (also referred to as the bottomhole assembly or "BHA") with a drill bit attached to the bottom end thereof. The drill bit is rotated to disintegrate the earth formations to drill the wellbore. The BHA includes devices and sensors for providing information about a variety of parameters relating to the drilling operations (drilling parameters), behavior of the BHA (BHA parameters) and formation surrounding the wellbore being drilled (formation parameters). More recently, certain sensors have been used in the drill bit to provide information about selected drill bit parameters during drilling of a wellbore.

The disclosure herein provides a drill bit that includes improved sensors, methods of making such drill bits and drilling systems configured to use such drill bits.

SUMMARY

In one aspect a method of making a drill bit is disclosed, which, in one embodiment, may include: providing a bit body; providing at least one sensor on a sensor body; preloading the at least one sensor; and placing the at least one preloaded sensor in the bit body.

In another aspect, a drill bit is disclosed that, in one embodiment, may include: a bit body; and at least one preloaded sensor in the bit body.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DETAILED DESCRIPTION

Figure 1:
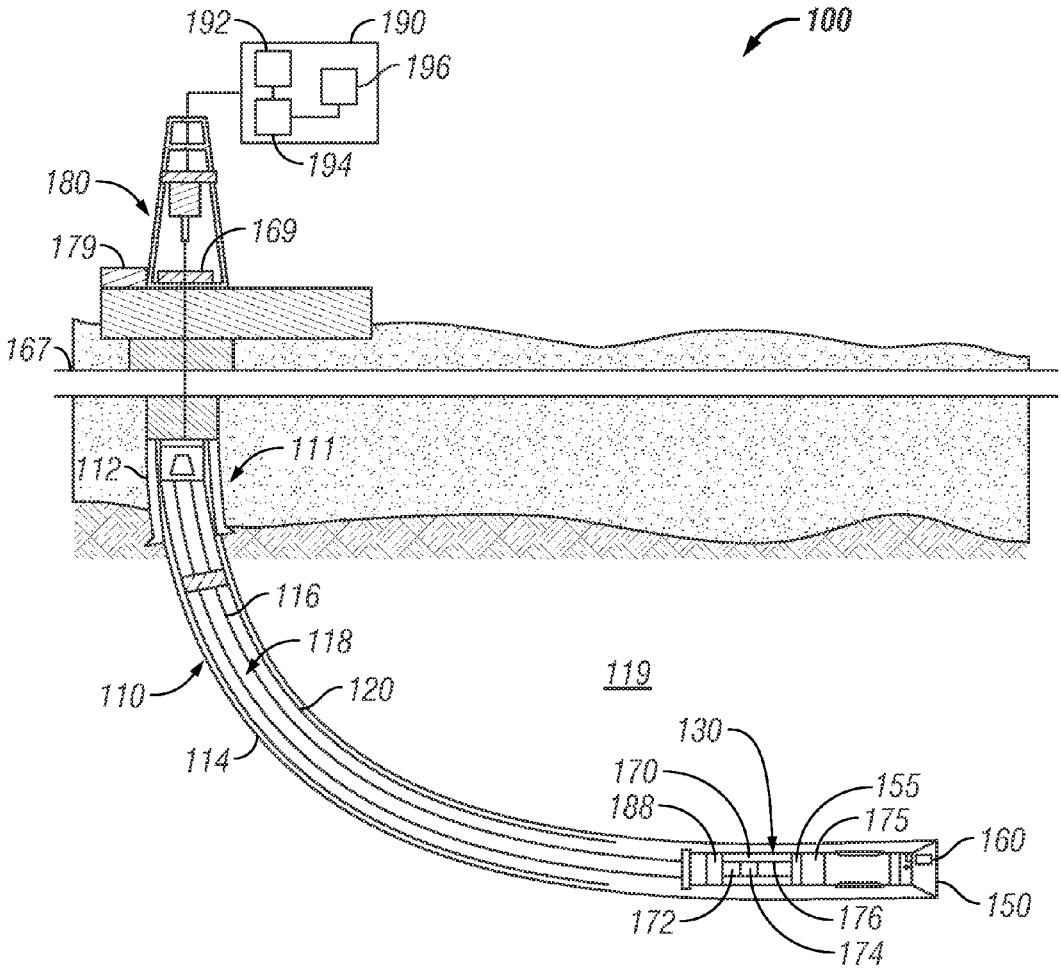
FIG. 1 is a schematic diagram of an exemplary drilling system configured to utilize a drill bit made according to one embodiment of the disclosure herein.

FIG. 1 is a schematic diagram of an exemplary drilling system 100 that may utilize drill bits disclosed herein for drilling wellbores. FIG. 1 shows a wellbore 110 that includes an upper section 111 with a casing 112 installed therein and a lower section 114 being drilled with a drill string 118. The drill string 118 includes a tubular member 116 that carries a drilling assembly 130 (also referred to as the bottomhole assembly or "BHA") at its bottom end. The tubular member 116 may be made up by joining drill pipe sections or a coiled-tubing. A drill bit 150 is attached to the bottom end of the BHA 130 for disintegrating the rock formation to drill the wellbore 110 of a selected diameter in the formation 119. The terms wellbore and borehole are used herein as synonyms.

The drill string 118 is shown conveyed into the wellbore 110 from a rig 180 at the surface 167. The exemplary rig 180 shown in FIG. 1 is a land rig for ease of explanation. The apparatus and methods disclosed herein may also be utilized with offshore rigs. A rotary table 169 or a top drive (not shown) coupled to the drill string 118 may be utilized to rotate the drill string 118 at the surface to rotate the drilling assembly 130 and thus the drill bit 150 to drill the wellbore 110. A drilling motor 155 (also referred to as "mud motor") may also be provided to rotate the drill bit. A control unit (or controller or surface controller) 190, which may be a computer-based unit, may be placed at the surface 167 for receiving and processing data transmitted by the sensors in the drill bit and other sensors in the drilling assembly 130 and for controlling selected operations of the various devices and sensors in the drilling assembly 130. The surface controller 190, in one embodiment, may include a processor 192, a data storage device (or a computer-readable medium) 194 for storing data and computer programs 196. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 is pumped under pressure into the tubular member 116. The drilling fluid discharges at the bottom of the drill bit 150 and returns to the surface via the annular space (also referred as the "annulus") between the drill string 118 and the inside wall of the wellbore 110.

Still referring to FIG. 1, the drill bit 150 includes one or more preloaded sensors 160 and related circuitry for estimating one or more parameters or characteristics of the drill bit 150 as described in more detail in reference to FIGS. 2-5B. The drilling assembly 130 may further include one or more downhole sensors (also referred to as the measurement-while-drilling (MWD) or logging-while-drilling (LWD) sensors, collectively designated by numeral 175, and at least one control unit (or controller) 170 for processing data received from the MWD sensors 175 and the drill bit 150. The controller 170 may include a processor 172, such as a microprocessor, a data storage device 174 and a program 176 for use by the processor to process downhole data and to communicate data with the surface controller 190 via a two-way telemetry unit 188. The data storage device may be any suitable memory device, including, but not limited to, a read-only memory (ROM), random access memory (RAM), flash memory and disk.

Figure 2:
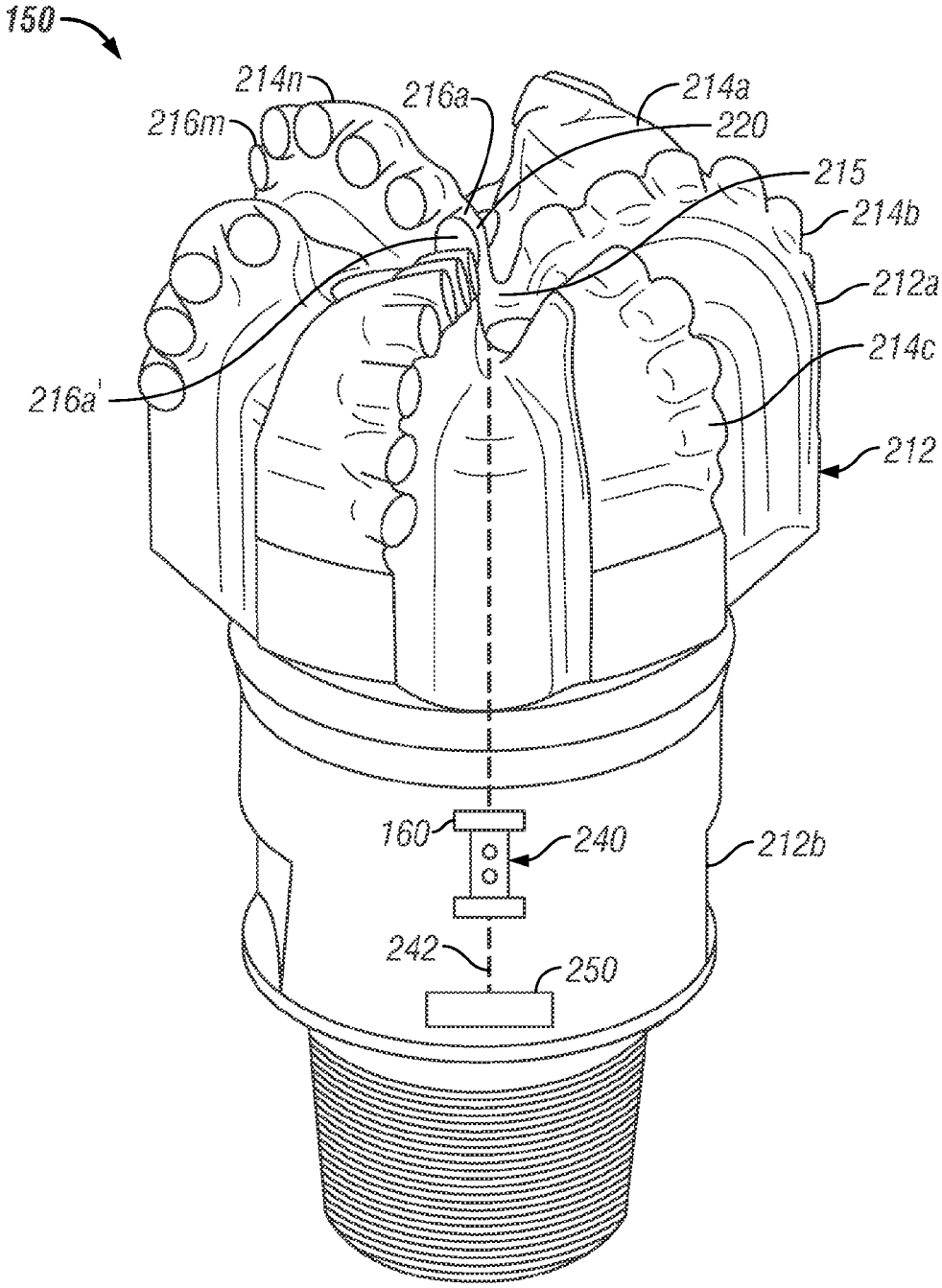
FIG. 2 is an isometric view of an exemplary drill bit incorporating one or more preloaded sensors made according to one embodiment of the disclosure.

FIG. 2 shows an isometric view of an exemplary PDC drill bit 150 that includes a sensor package 240 placed in the shank 212*b* according to one embodiment of the disclosure. A PDC drill bit is shown for explanation purposes and not as a limitation. Any other type of drill bit may be utilized for the purpose of this disclosure. The drill bit 150 is shown to include a drill bit body 212 comprising a cone 212*a* and a shank 212*b*. The cone 212*a* includes a number of blade profiles (or profiles) 214*a*, 214*b*, . . . 214*n*. A number of cutters are placed along each profile. For example, profile 214*a* is shown to contain cutters 216*a*-216*m*. All profiles are shown to terminate at the bottom of the drill bit 215. Each cutter has a cutting surface or cutting element, such as element 216*a*' of cutter 216*a*, that engages the rock formation when the drill bit 150 is rotated during drilling of the wellbore. Each cutter 216*a*-216*m* has a back rake angle and a side rake angle that collectively define the aggressiveness of the drill bit and the depth of cut made by the cutters. In one aspect, the sensor package 240 may house any suitable sensor, including a weight sensor, torque sensors, sensor for determining vibrations, oscillations, bending, stick-slip, whirl, etc. For ease of explanation, and not as any limitation, weight and torque sensors are used to describe the various embodiments and methods herein. In one aspect, the weight sensor and the torque sensor may be disposed on a common sensor body. In another aspect, separate weight and torque sensors may be placed at suitable locations in the drill bit 150. In FIG. 2 these sensors are shown placed proximate to each other in the shank 212*b*. Such sensors also may be placed at any other suitable location in the drill body 212, including, but not limited to, the crown 212*a* and shank 212*b*. Conductors 242 may be used to transmit signals from the sensor package 240 to a circuit 250 in the bit body, which circuit may be configured to process the sensor signals. The circuit 250, in one aspect, may be configured to amplify and digitize the signals from the weight and torque sensors. The circuit 250 may further include a processor configured to process sensor signals according to programmed instructions accessible to the processor. The sensor signals may be sent to the control unit 170 in the drilling assembly for processing. The circuit 250, controller 170 and the controller 140 may communicate among each other via any suitable data communication method.

Figure 3:
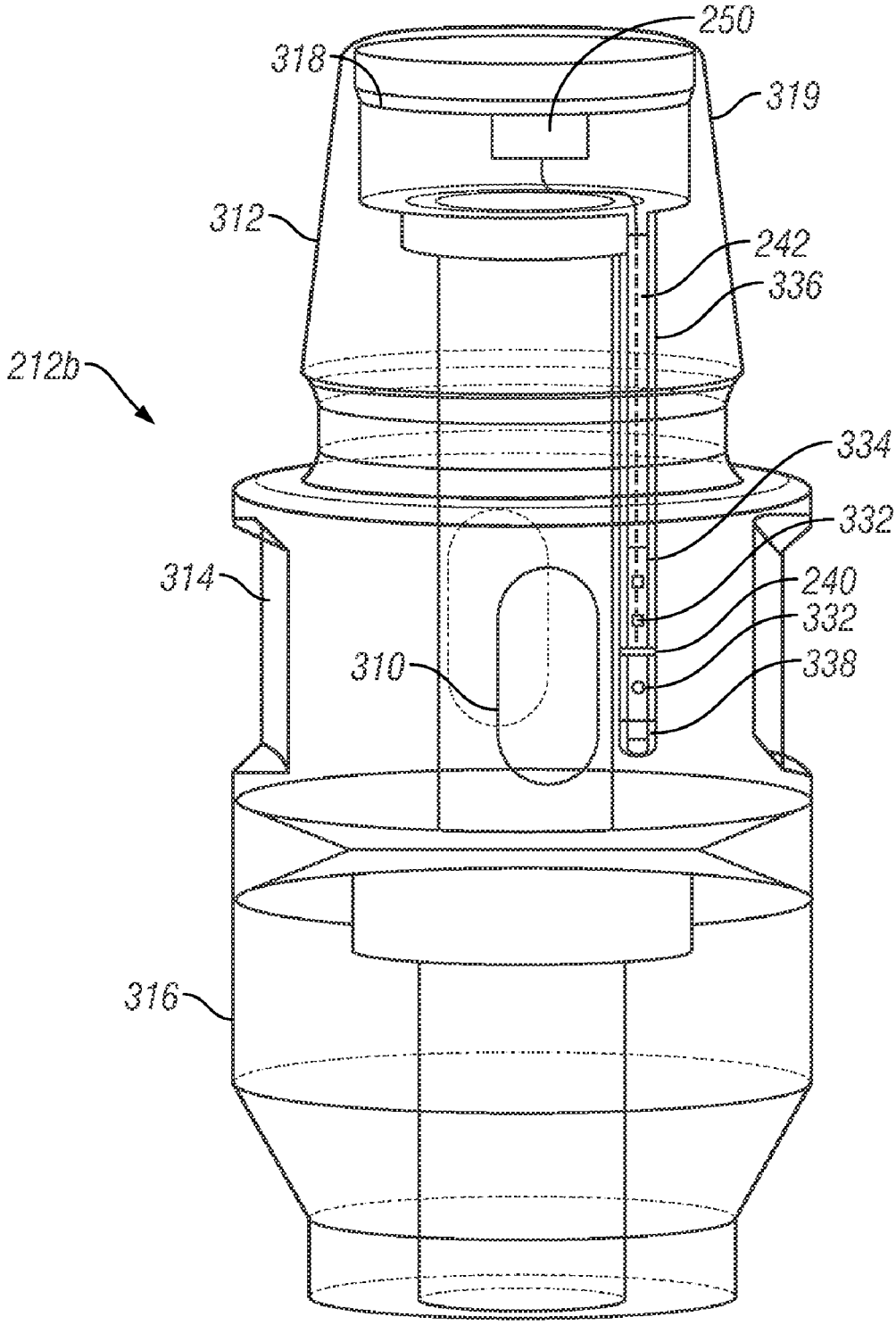
FIG. 3 is an isometric view showing placement of one or more preloaded sensors in the shank of an exemplary drill bit, according to one embodiment of the disclosure.

FIG. 3 shows certain details of the shank 212*b* according to one embodiment of the disclosure. The shank 212*b* includes a bore 310 therethrough for supplying drilling fluid to the cone 212*a* of the drill bit 150 and one or more circular sections surrounding the bore 310, such as a neck section 312, a middle section 314 and a lower section 316. The upper end of the shank includes a recessed area 318. Threads 319 on the neck section 312 connect the drill bit 150 to the drilling assembly 130. The sensor package 240 containing the weight sensor 332. The torque sensor 334 may be placed at any suitable location in the shank 212*b*. In one aspect, the sensor package 240 may be placed in a cavity or recess 338 in section 314 of the shank 212*b*. Conductors 242 may be run from the sensors 332 and 334 to the electric circuit 250 in the recess 318. The circuit 250 may be coupled to the downhole controller 170 (FIG. 1) by conductors that run from the circuit 250 to the controller 170 or via a short-hop transmission method between the drill bit and the drilling assembly 130. In one aspect, the circuit 250 may include an amplifier that amplifies the signals from the sensors 332 and 334 and an analog-to-digital (A/D) converter that digitizes the amplified signals. In another aspect, the sensor signals may be digitized without prior amplification. The sensor package 240 is shown to house both the weight sensors 332 and torque sensors 334. The weight and torque sensors may also be separately packaged and placed at any suitable location in the drill bit 150. C-A1

Figure 4:
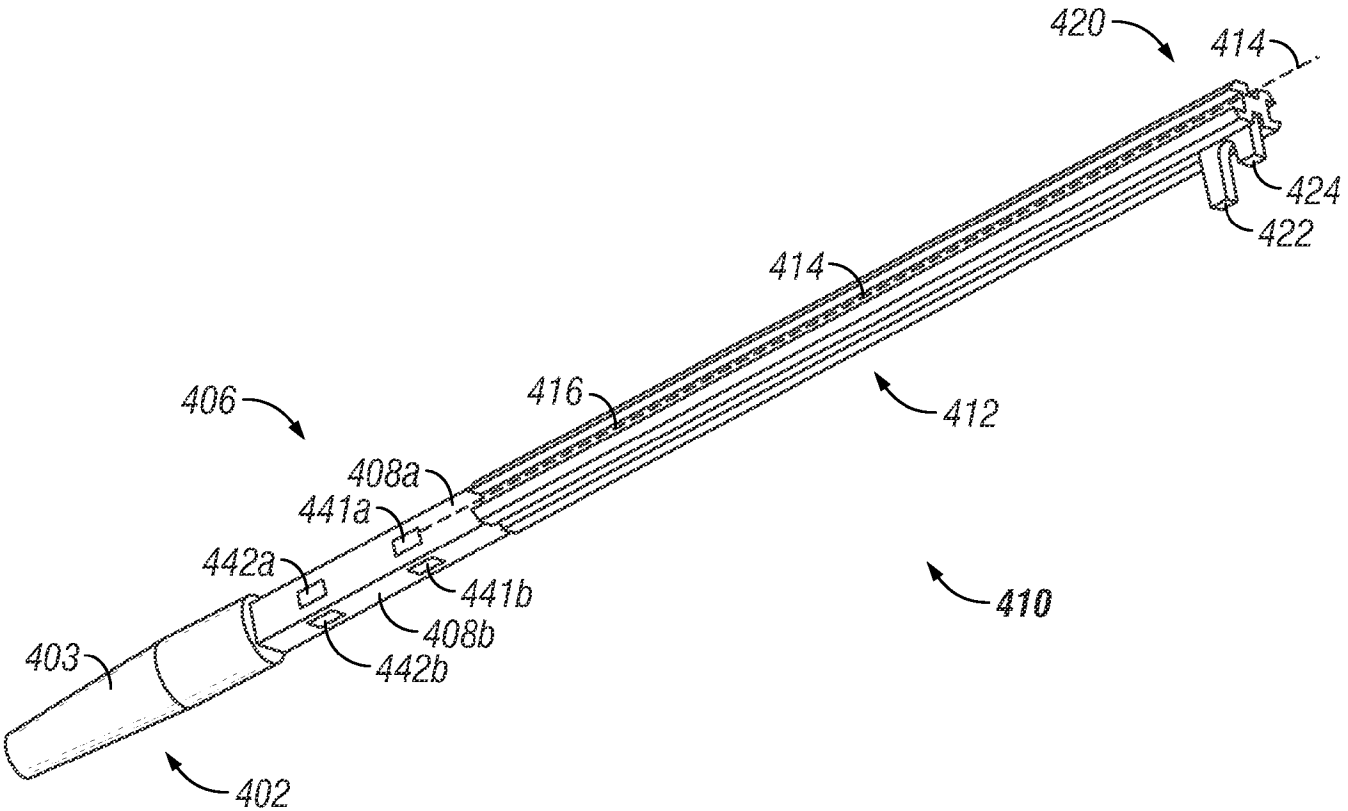
FIG. 4 is an isometric view of a sensor body with one or more sensors thereon, which sensor body includes ends that may be used to preload the one or more sensors.

FIG. 4 shows an isometric view of certain details of the sensor 240 shown in FIG. 2, according to one embodiment of the disclosure. In one aspect, the sensor 240 may include a sensor body 410 having a lower section 402, a sensor base member 406 and an upper section 312. In one embodiment, the lower section 402 may include a tapered end 403 compliant with the bottom end of the cavity 338 (FIG. 3). The sensor base member 406, in one embodiment, may be a rectangular member that includes flat sections 408*a* and 408*b*. FIG. 4 shows sensors 441*a* and 441*b* respectively attached to flat sections 408*a* and 408*b*. In one aspect, sensor 441*a* may be a weight sensor configured to provide signals corresponding to the weight on bit 150. Sensor 441*b* may be a second weight sensor placed substantially orthogonal or 180 degrees from the sensor 441*a*. These sensors may be utilized together to compensate for errors in such sensors. Similarly, torque sensors 442*a* and 442*b* may be placed on the sensor base section 406. Any other desired sensors may be similarly placed on the sensor base section 206. In one aspect, the various sensors may be coupled or attached to the base member 406 in a manner such that stressing the base section 206 will preload the sensors. For example, if sensors 441*a* and 441*b* are micromachined weight sensors attached to the base section 406, they may be loaded or preloaded when a tensile force is applied to the base section 406. On the other hand, if the sensors 442*a* and 442*b* are torque sensors attached to the base section 406, applying torsional force to base section 406 with the lower end 402 held in a fixed position will preload the torque sensors 442*a*. Any other preloaded sensor may be utilized for the purpose of this disclosure. Conductors 414 may be run through a channel 416 in the upper section 312 to supply power from a source to the sensors 441*a*, 441*b*, 442*a* and 442*b* and to transfer signals and data generated by these sensors to the control circuit 250 (FIG. 3). In another aspect, the sensor body 400, in one embodiment, may include a first lever member 422 extending from a side of the upper section 412 configured to be locked in place in the shank and a second lever member 424 extending from the upper section 412 configured for use to preload the sensors 441*a*, 441*b*, 442*a* and 442*b*, as described in more detail in reference to FIG. 5.

Figure 5A:
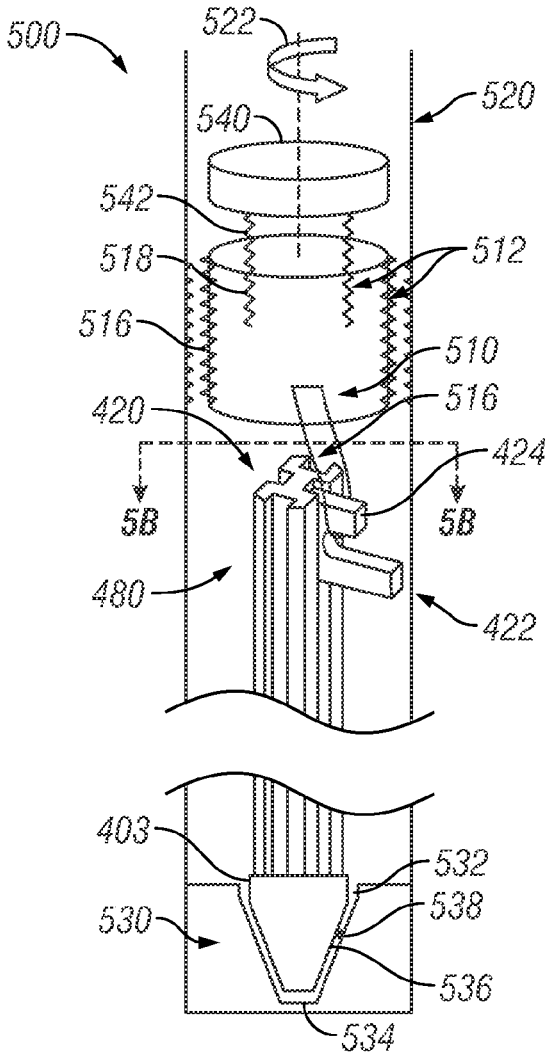
FIGS. 5A and 5B are schematic diagrams of a turn screw mechanism that, in conjunction with an end of the sensor body shown in FIG. 4, may be utilized to preload the one or more sensors.
Figure 5B:
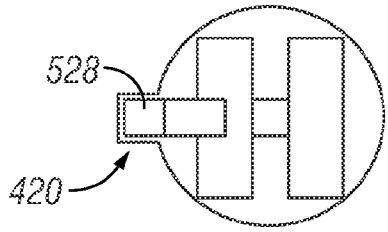

FIG. 5A is an isometric view of a preloading device 500 configured to preload the sensors on the sensor body 410. FIG. 5B shows a view of the preloading device taken along a section A-A of FIG. 5A. FIG. 5B shows placement of a key hole in the cavity 520 in the shank configured to lock the upper end 420 of the sensor body 410 in a torsional direction, prior to preloading the sensors. In one aspect, the preloading device 500 may include a movable member (also referred to herein as a "traveling sleeve") 510 having a threaded section 512 configured to move downward (i.e., toward the sensor body 410, and upward (i.e., away from the sensor body 410), in the cavity 520 along compliant threads 516 in the cavity 520. For ease of explanation only and not as a limitation, the movable member 510 is shown to move or travel downward when rotated counterclockwise and upward when rotated clockwise. The movable member 510 may include a linkage 516 configured to latch on to the upper lever member 424 of the sensor body 410. The preloading device 500 also may include a suitable device, such as a set screw 540, to move the movable member 510 in the cavity 520. In one aspect, the set screw 540 may include threads 542 that screw into compliant threads 518 in the movable member 540. In operation, when the set screw 540 is rotated in one direction (for example, counter-clockwise 522), it will advance the movable member 510 downward (i.e., toward the sensor body 410) and when rotated in the opposite direction (i.e., clockwise) will move the movable member 510 upward (i.e., away from the sensor body 410).

Referring to FIGS. 4, 5A and 5B, to preload the sensors, the sensor body 410 may be placed in the cavity 520 with the lower lever member 422 placed in the key hole 528 in the cavity 520 to lock the upper end 420 in the torsional direction. The bottom end 403 of the sensor body 410 is secured at the bottom end 530 of the cavity 520 to prevent motion of the bottom end 403 in the axial and torsional directions. Any suitable method may be utilized to secure the bottom end 403 for the purpose of this disclosure. In one aspect, an epoxy 532 may be utilized to secure the bottom end 403 in a compliant section 534 in the cavity 540. Alternatively, or in addition to, one or more key members 536 on the sensor body 410 may be locked in position in compliant key holes 538 in the cavity 520.

After securing the bottom end 403 of the sensor body 410, the movable member 510 may be screwed in the cavity 520 by rotating it counter-clockwise until the linkage 516 engages the upper lever member 424 of the sensor body 410. The screw member 540 may then be rotated clockwise to move the sensor body 410 upward to exert tensile force on the sensor body 410 to preload the weight sensors 241*a* and 241*b*. The rotational movement of the screw member 540 also rotates the sensor body 410, thereby preloading the torque sensors 242*a* and 242*b*. The preloading of the sensors may be continued until the output (typically in volts) from each such sensor corresponds to a predetermined maximum preload value. For example, the weight sensors 241*a* and 241*b* may be designed for a maximum weight of 20,000 lbs and the corresponding voltage output voltage may be Vw(max) (for example, approximately 5 volts). The outputs from the sensors may be continuously measured using the conductors 414 (FIG. 4). The preloading process may be stopped when the outputs from the various sensors correspond to their respective desired values. The desired output value from a particular sensor may then be set to calibrate that sensor. For example, if the output value from the sensor 241*a* is 4.9 volts then the weight range of 0-20,000 lbs. will correspond to the output range of 0-4.9 volts. The other sensors may be similarly calibrated. The above preloading mechanism is merely an example of one type of a preloading device. Any preloading device and method may be utilized for preloading the sensors in the drill bit for the purpose of this disclosure. It will be noted that terms preloading and loading are used as synonyms. In another aspect the preloading device 500 may be configured to preload the weight sensor under compression. In such a configuration, the downward motion of the movable member 510 will cause the linkage 516 or another suitable mechanism to compress the sensor body 480, thereby preloading the weight sensor. It should be noted that any suitable device or method may be utilized for preloading one or more sensors in the drill bit for the purpose of this disclosure.

In another aspect, the sensors may be preloaded prior to being placed in the drill bit. For example, the sensors may be placed in a housing, preloaded, and then mounted inside a cavity in the bit body. It should be noted that weight and torque sensors have been used herein as examples for the purposes of explaining the concepts of the apparatus and methods described herein and not as limitations. Any other sensor may be preloaded and used in any type of a bit for the purposes of this disclosure. Such other sensors, for example, may include strain gauges for measuring a shearing stress or a bending stress.

Thus, in one aspect, a method of making a drill bit is provided that in one embodiment may include: providing a bit body; preloading a sensor; and securing the loaded sensor in the bit body. In one aspect, the sensor may include a sensor element attached to a sensor body in a manner such that when the sensor body is loaded, by, for example, a tensile force or rotational force to the sensor body, the sensor will be loaded accordingly. In one aspect, the process of loading the sensor may include placing the sensor body in a shank of the bit body, preloading the sensor, securing the preloaded sensor in a manner in the bit body in a manner that the enables the sensor to retain the preloading (i.e., remain in the preloaded condition). In one aspect, the sensor may be preloaded after placing the sensor in the shank of the bit body. The sensor may include a sensor element on a sensor body having a first end and a second end, wherein the process of loading the sensor may include: securing the first end in the bit body, preloading the sensor using the second end, and securing the second end in a manner that enables the sensor to remain in preloaded. In one aspect, the first end may be secured by affixing the first end in a cavity in the shank, applying a load or force on the second end to load the sensor, and securing the second end in the shank.

In another aspect, the sensor may be preloaded outside the shank. In one aspect, the process of preloading the sensor may include: placing the sensor body 410 in housing such as a tubular member or chamber; preloading the sensor in the housing; and placing the housing with the preloaded sensor in the bit body.

The sensor may include any suitable sensor, including, but not limited to, a weight sensor, torque sensor, strain gage, a sensor for measuring bending and stress. In another aspect, the sensor may be a micro-machined sensor securely placed on the sensor body. In another aspect, the sensor may be provided on a sensor body in a manner that applying force or load on the sensor body will load the sensors. When a weight sensor and a torque sensor are placed on a common sensor body, the method of preloading such sensors may include applying a tensile force on the sensor body to preload the weight sensor and applying a torsional force on the sensor body to preload the torque sensor. The method may further include running one or more conductors from the sensor to a location past the sensor body. In another aspect, the method may include placing a processor in the bit body, wherein the processor is configured to process signals generated by the sensors. The method may further include preloading the sensor until an output signal from the sensor reaches a selected value, and correlating the range of the output from the sensor to a range of a parameter of interest.

In another aspect, a drill bit is disclosed that in one embodiment may include a bit body and at least one preloaded sensor in the bit body. In another aspect, the sensor may include a sensor element on a sensor body that includes a first end and a second end, wherein the first end is secured in the bit body and the second is locked in a place in the bit body after the sensor is preloaded. The sensor may be configured to provide information about one of: weight; torque; strain; bending; vibration; oscillation; whirl; and stick-slip. In one aspect, the first end includes a tapered section affixed in a cavity in the shank of the bit body. In one aspect, the sensor may include a weight sensor and a torque sensor on a sensor body, and wherein applying a tensile force to the sensor body preloads the weight sensor and applying a torsional force to the sensor body preloads the torque sensor. In another aspect, the sensor may be configured to produce an output signal when power is applied to the sensor, which output signal is representative of a maximum range of a parameter of interest. In another aspect, the drill bit may include a processor in the bit body configured to process signals from the sensor. In one aspect, the sensor may be a micro-machined sensor affixed to the sensor body in a manner such that when a stress is applied to the sensor body, the sensor is preloaded. In yet another aspect, a drilling apparatus is provided, which, in one embodiment, may include a drilling assembly having drill bit attached to a bottom end of the drilling assembly, wherein the drill bit includes a bit body and at least one preloaded sensor in the bit body.

The foregoing description is directed to certain embodiments for the purpose of illustration and explanation. It will be apparent, however, to persons skilled in the art that many modifications and changes to the embodiments set forth above may be made without departing from the scope and spirit of the concepts and embodiments disclosed herein. It is intended that the following claims be interpreted to embrace all such modifications and changes.

What is claimed is:

1. A method of making a drill bit, comprising:

providing a bit body;

providing at least one sensor including a sensor element on a sensor body having a first end and a second end;

preloading the at least one sensor to a selected value; and securing the at least one sensor in the bit body in a manner that enables the sensor to remain preloaded in the bit body, wherein the first end of the sensor body is secured in the bit body and the second end of the sensor body is locked in a place in the bit body after the sensor is preloaded.

2. The method of claim 1, wherein providing the at least one sensor comprises providing a sensor that is one of: a weight sensor; a torque sensor;

and a sensor configured to measure one of strain, torsion, shearing, bending, vibration, oscillation, whirl and stick-slip.

3. The method of claim 1, wherein preloading the at least one sensor comprises preloading the at least one sensor after placing the at least one sensor in the bit body.

4. The method of claim 1, wherein preloading the at least one sensor comprises securing the first end in the bit body and preloading the at least one sensor using the second end.

5. The method of claim 1, wherein preloading the at least one sensor comprises preloading the sensor outside the bit body.

6. The method of claim 1, wherein the at least one sensor comprises a weight sensor and a torque sensor on a sensor body and wherein preloading the at least one sensor comprises applying a tensile force to the sensor body to preload the weight sensor and a torsional force on the sensor body to preload the torque sensor.

7. The method of claim 6, further comprising applying the tensile force and the torsional force while the sensor body is inside a shank of the bit body.

8. The method of claim 1 further comprising running a conductor from the at least one sensor to a circuit in the bit body.

9. The method of claim 1, wherein preloading the at least one sensor comprises:

securing a first end of a sensor body in the bit body;

preloading the at least one sensor using a second end of the sensor body; and securing the second end of the sensor body in the bit body in a manner that enables the at least one sensor to retain the preloading.

10. The method of claim 1 further comprising preloading the at least one sensor until the at least one sensor produces an output signal that represents a predetermined maximum preloading level.

11. The method of claim 1 further comprising placing a processor in the bit body configured to process signals from the at least one sensor.

12. The method of claim 1, wherein the at least one sensor is a micro-machined sensor affixed on the sensor body such that when a stress is applied to the sensor body, the micro-machined sensor produces a signal corresponding the applied stress.

13. A drill bit, comprising:

a bit body; and at least one sensor in the bit body preloaded to a selected value, wherein the at least one sensor includes a sensor element on a sensor body having a first end and a second end, wherein the first end is secured in the bit body and the second end is locked in a place in the bit body after the sensor is preloaded.

14. The drill bit of claim 13, wherein the first end includes a tapered section affixed in a cavity in the bit body.

15. The drill bit of claim 13, wherein the at least one sensor is configured to provide measurements about one of: weight; torque; strain; shearing; bending; vibration; oscillation; whirl; and stick-slip.

16. The drill bit of claim 13, wherein the at least one sensor includes a weight sensor and a torque sensor on a common sensor body and wherein the weight sensor is preloaded by applying a tensile force to the sensor body and the torque sensor is preloaded by applying a torsional force to the sensor body.

17. The drill bit of claim 13, wherein the at least one sensor produces an output signal when power is applied to the at least one sensor that is representative of a maximum range of a parameter of interest.

18. The drill bit of claim 13 further comprising a processor in the bit body configured to process signals from the at least one sensor.

19. The drill bit of claim 13, wherein the at least one sensor is a micro-machined sensor affixed on the sensor body in a manner such that when a stress is applied to the sensor body, the at least one sensor is stressed in a known proportion to the applied stress.

20. A drilling apparatus, comprising:

a drilling assembly configured to provide measurements relating to a parameter of interest relating to drilling of a wellbore; and a drill bit attached to an end of the drilling assembly, wherein the drill bit includes a bit body and at least one sensor in the bit body preloaded to a selected value, wherein the at least one sensor includes a sensor element on a sensor body having a first end and a second end, wherein the first end is secured in the bit body and the second is locked in a place in the bit body after the sensor is preloaded.

* * * * *